US006671911B1

(12) United States Patent
Hill et al.

(10) Patent No.: US 6,671,911 B1
(45) Date of Patent: Jan. 6, 2004

(54) CONTINUOUS WAVE CUSHIONED SUPPORT

(75) Inventors: Charles C. Hill, Del Mar, CA (US); Theodore B. Hill, San Diego, CA (US); Carly A. Anderson, Solana Beach, CA (US)

(73) Assignee: Hill Engineering, San Diego, CA (US)

( * ) Notice: Subject to any disclaimer, the term of this patent is extended or adjusted under 35 U.S.C. 154(b) by 0 days.

(21) Appl. No.: 09/574,939

(22) Filed: May 19, 2000

Related U.S. Application Data

(60) Provisional application No. 60/135,407, filed on May 21, 1999.

(51) Int. Cl.[7] ..... A47C 27/10

(52) U.S. Cl. ..... 5/713; 5/710; 5/655.3

(58) Field of Search ..... 5/713, 710, 709, 5/76, 653, 655.9, 654, 740, 655.3; 297/452.41

(56) References Cited

U.S. PATENT DOCUMENTS

| | | | | | |
|---|---|---|---|---|---|
| 5,267,365 | A | * | 12/1993 | Walter | 5/683 |
| 5,379,471 | A | * | 1/1995 | Holdredge | 5/456 |
| 5,533,217 | A | * | 7/1996 | Holdredge | 5/453 |
| 6,014,784 | A | * | 1/2000 | Taylor et al. | 5/713 |
| 6,092,249 | A | * | 7/2000 | Kamen et al. | 5/653 |
| 6,108,843 | A | * | 8/2000 | Suzuki et al. | 5/713 |

FOREIGN PATENT DOCUMENTS

| | | |
|---|---|---|
| DE | 43 24 508 | 1/1995 |
| DE | 199 52 170 | 5/2001 |
| EP | 0 823 248 | 2/1998 |
| FR | 1.291.237 | 3/1962 |
| GB | 2 311 217 | 9/1997 |
| WO | WO 96/10938 | 4/1996 |
| WO | WO 96/29918 | 10/1996 |

OTHER PUBLICATIONS

Airlines Installing Comfy Seats by David Cay Johnston, The San Diego Union–Tribune, exact date unknown.
Comfort Zone, by Carmen Pang, Automotive & Transportation Interiors, Nov. 1999.
1998 Seville, by Bob Storck, The San Diego Union–Tribune, Oct. 12, 1997.
The Ultimate Seat? By Dan McCosh Popular Science, Nov. 1997.
Care Guard by Invacare 8000, Care Guard Catalog Invacare, 1998.
Bio Compression Therapeutic Support Surfaces, Bio Compression Systems Inc. brochure, exact date unknown.
Span–America Medical Systems, Inc. brochure, 1998.
Biocomfort Model BC–8000 Low Air–Loss Therapy Systems, Bio Compression System, Inc. brochure, exact date unknown.
Treco International Co., Ltd. catalog, exact date unknown.
Suan, Dah Dih Enterprises Co. brochure, exact date unknown.
PXM 3666, Lotus catalog, exact date unknown.
Pressure Ulcer Prevention with the Lotus DU 4072 Static Air Flotation Mattress by Thomas H. Doyle, Edmund Caporaso, Ronald B. Robbins, Patricia D. Rzewnicki, exact date unknown.

(List continued on next page.)

*Primary Examiner*—Heather Shackelford
*Assistant Examiner*—Fredrick Conley
(74) *Attorney, Agent, or Firm*—Brown, Martin, Haller & McClain LLP

(57) ABSTRACT

Multiple foam-filled cells form a cushioned support surface of a seat or mattress. Individual cells may be collapsed by connection through a manifold and valve to a vacuum source. The collapsed cell essentially removes contact pressure in a localized area of the person supported on the surface and restores localized blood flow. After a predetermined time interval, atmospheric pressure is readmitted to the cell.

19 Claims, 5 Drawing Sheets

OTHER PUBLICATIONS

Pressure Ulcer Prevention with the Lotus Deep Air3787 Static Air Flotation Mattress by Thomas H. Doyle, Ronald B. Robbins, exact date unknown.
AIR3787, Lotus Brochure, exact date unknown.
WC1517, Lotus Brochure, exact date unknown.
DU4072AS, Lotus Brochure, exact date unknown.
MD 3677, Lotus Brochure, exact date unknown.
GL 3666, Lotus Brochure, exact date unknown.
HMX3666, Lotus Brochure, exact date unknown.
Micropulse Unveils First Patient Support System Clinically Shown to Prevent Pressure Ulcers Micropulse(R) or Table System Maintains Blood Flow in Surgery Patients, PR Newswire 1999.
The No–sorz plus+, DTI Group, Inc., exact date unknown.
'Active' Wheelchair Seat Designed to Prevent Pressure Ulcers–Sandia Teams with Private Sector to Address $5 Billion Problem, Sandia Science News, vol. 31, No. 1, Feb. 1996.
The Panasonic Shiatsu Massage Lounger, Brookstone Catalog, exact date unknown.
Trilogy Part II–Engineering Marketplace: Design Tools of the Future, Poetic Technologies, Oct. 1999.
Leap Chair A0–FC0305, Levenger catalog, exact date unknown.
The Office–1998 Technology Buyer's Guide, Time, Nov. 23, 1998.
Rear Support by Dan Davis, Appliance, Apr. 1998.
ARC Ergonomics, ARC brochure, Oct. 7, 1996.
The Sharper Image catalog, exact date unknown.
Model 7000, ConformaMed brochure, exact date unknown.
Synergy Chair, Tempur–Pedic brochure, exact date unknown.
Micropulse Inc. Contracts with Purchase Connnection(R) to help Hospitals Prevent Bedsores, Heads Up, 1998.
Frost & Sullivan —Speciality Bed and Support Surface Markets get a Lift from Aging Baby Boomer Population, Heads Up, 1998.
Motorola Sensors Power Advanced "Air Controlled" Hospital Beds, Heads Up, 1998.
New Mattress Technology Introduced, Alternating Pressure for Wheelchairs Available, New Automatic Turning Mattress,—New Product Briefs, Home Healthcare Today, exact date unknown.
Dynamicaire Sleep Surface, Hill–Rom, 1995.
Roho Airlite Cushion, Wheelchair Seats and Accessories, exact date unknown.
Waffle Brand Sead Cushions, EHOB brochure, exact date unknown.
Seating & Positioning, Invacare Corporation, 1998.
ConformaMed Model 7000, exact date unknown.
Plexus Medical, Home Health Products Catalog, Jun. 1998.
Don't Decide Now, Sleep on It, Tempur–Pedic, 1997.
Brookstone catalog, exact date unknown.

* cited by examiner

CONTINUOUS WAVE CUSHIONED SUPPORT

This application claims the benefit of provisional application Ser. No. 60/135,407 filed May 21, 1999.

BACKGROUND OF THE INVENTION

Modern people spend long periods of time continually sitting at our work places or homes and while traveling between these places. The human body is not physiologically suited to this inactivity. In earlier times mankind spent little time in static sitting positions and much time walking. Our bodies are not well evolved for continual sitting. The physiology of sitting for an average adult of 166 pounds weight applies this load to about a fifteen inch square area (225 sq. inches). If the seating surface could achieve a perfectly uniform distribution over this area the unit pressure would amount to 38 mmHg. The normal human capillary and small vein pressure is 11 to 33 mmHg. A seating contact pressure which exceeds the blood pressure causes the flow of blood, and therefore the supply of oxygen, to be blocked. In actual seats there are regions where the local sitting contact pressure is much higher than the local blood pressure resulting in more severe localized blockage. For short time periods (a few minutes) this blockage causes little discomfort and no physiological damage. However, after a prolonged period the reduction in blood flow results in the sensation of discomfort which eventually becomes severe. If blood flow is not restored, tissue death ensues. The sensation of discomfort prompts us to frequently relieve pressure and restore blood flow by adjusting our position during extended sitting or reclining situations.

Paralyzed humans do not sense discomfort or pain signals when normal blood flow is occluded and are in danger of developing pressure sores (decubitus ulcers) if they are not regularly repositioned. The same problem arises for many other bedridden patients.

Various attempts have been made to alleviate fatigue and other symptoms associated with prolonged inactivity on a chair or bed. Although the effects are very different, convalescing or paralyzed patients, equipment operators and office workers all suffer damage from the same fundamental cause. The supports (chairs or beds) on which they are at rest, place sufficient pressure on the contacted portion of their bodies that circulation is impaired, which denies tissue needed oxygen. The damage may range from discomfort to debuctus ulcers. The effect on an office worker may be restlessness and a need to frequently shift position while that on a bedridden patient may be life-threatening skin lesions.

These problems have led to a range of solutions from inflatable mattress segments to carefully designed office chairs designed to distribute pressure as uniformly as possible.

Passive cushions (seat and mattress constructions) have been developed to make sitting or reclining more comfortable by using soft cushion materials and careful contouring of the seat structure. These materials include foam plastic or elastomeric materials, encased gels, air filled cushions and refined spring and membrane support systems. Passive support systems, no matter how uniformly perfect the load distribution, will still block capillary blood flow because of the weight and contact surface areas of humans.

Prior art inflatable cushions either require active pressure inflation with no full-height reserve cushioning (for use in the absence of pump pressure) or, where passive or backup foam cushioning is provided in a vacuum-driven device, half of the surface area or less is available for cushioning when the vacuum chambers are collapsed (or pressure chambers deflated). Passive systems, especially those for seating surfaces, cannot prevent the closing off of capillaries. Even with perfect distribution of pressure, there is not enough surface area on the human posterior to support the body's weight without cutting off blood flow which results in discomfort and, eventually, tissue damage. The same is true for localized areas on the bodies of paralyzed or otherwise bedridden patients. For example the heels of bedridden patients frequently develop bed sores.

Most prior art inflatable cushions have cells that are pressurized above atmospheric pressure by a pump and alternately collapsed by allowing the pressurized air to be exhausted. These devices provide no support when the pump is not operational. Prior cushions that incorporate inflatable cells combined with foam use the foam only when the pump is not operational. Therefore, air pressure and the power necessary to create it must do all the work of support when the system is active.

Vacuum or pressurized devices that provide inflation of, or collapsing of, cells in groups have typically provided no more than two or three groups of cells to be independently controlled. The failure to provide more precise control over multiple cells is attributable in part to the fact that manifolding in the past was inadequate to support more than a minimal number of groups of cells. In vacuum systems, any attempt to run vacuum hose between groups of cells or other inflatable/deflatable structures will normally result in a pinching or other cutoff of the vacuum tubing during deflation. Even where two or more groups of cells are deflated, the amount of vacuum-pumping power that is required to deflate a high percentage of the total cell count in a reasonable time is substantial and therefore both energy consumption and noise are a problem.

There have been active support systems developed for both bedridden and seated individuals. Devices that rely on suction to remove part of the support to allow tissue recovery have typically relied on an inactive foam portion to provide the sole support during the vacuum phase as in the PCT publication WO 86/02244 (Ophee). Devices that have taken the form of alternating pressure pad arrays are periodically inflated with compressed air or allowed to deflate under the weight of the user. One of the earliest alternating pressure pads is disclosed in U.S. Pat. No. 3,199,124, Grant. This mattress uses active, alternating pressure pads for the bedridden. The device inflates one half of the support surface at a time which results in doubling the contact pressure loading on the user relative to the same pad fully inflated and not being cycled. These mattresses are also at a disadvantage because they can only be used when inflated and operational; there is no cushioning support when inactive. Also, there is no protection from bottoming out of the cushion. Thus if the subject using the support can not be fully supported on the air cushion, the deflation of cells will have no effect of removing the pressure from the surface of the skin.

Some active seats have combined foam and inflatable tubing to create an alternating pressure pad with extra support. In U.S. Pat. No. 3,867,732, Morrell discloses a cushion which has a plurality of inflatable tubes on top of a foam cushion. There is support from the cushion even if the tubes are deflated. In U.S. Pat. No. 5,388,292, Stinson et al. disclose a mattress with inflatable bladders containing elongated foam members. With a supply of air pressure to the bladders, the foam mattress converts to an air mattress and the foam no longer carries the load of the user.

There are other examples of cushions which use foam encased bladders. Some are used to hold the cushion in a custom contoured form which is created by the user's body, as in U.S. Pat. No. 6,012,188, Daniels.

In U.S. Pat. No. 5,797,155, Maier, one or more support chambers are filled with foam and a fluid such as air. The chambers are connected such that a pressure equilibrium is reached with flow of the fluid between the chambers.

There are also self-inflating air mattresses which contain foam for cushioning. Such air mattresses can be deflated and made compact by removing the air, collapsing the foam, and closing an air valve. They are reinflated when the mattress air valve is opened and the foam returns to original size. U.S. Pat. No. 4,025,974, Lea et al., discloses a self-inflating air mattress of this sort.

The combination foam and fluid bladders described above are all passive cushions, and are inadequate for reducing pressure on all surfaces of the skin.

Active cushions which incorporate foam are better at relieving pressure, but have a major disadvantage in their basic structure. They require air pressure to support the entire weight of the user while in operation. When sections of the seat are deflated, the inflated sections must take on the additional load and support all the weight to prevent the cushion from bottoming out. Because of this construction, the foam in the seat is not used at all for supporting the user. It is only utilized when the seat is nonoperational or if the air bladders are bottomed out while operating. In either case there is no way to relieve pressure in localized areas to below capillary pressure. Therefore, the cushion's pressure-relieving objective is unattainable.

One method of providing pressure relief while utilizing foam as a support structure within the cushion, is to periodically remove sections of the support cushion from the surface of the user so that blood flow to these areas is periodically restored and the tissues reoxygenated. This method was used by O'Brien as disclosed in U.S. Pat. No. 4,644,593. A mattress is provided with a relief device underneath the cushion which is periodically, mechanically, drawn downward to remove the cushion from the surface of the user. U.S. Pat. No. 4,799,276, Kadish, also discloses a mattress with vertical displaceable supports. These supports are withdrawn when the pressure on the support from the user's body reaches a maximum level. These systems are complex and require a substantial amount of power to operate and therefore produce high levels of noise.

Another attempt at providing pressure relief is disclosed in U.S. Pat. No. 5,983,428, Hannagan. This is an alternating pressure pad with three arrays of inflatable cells. The cells are inflated to support the user and periodically deflated to relieve pressure on the surface of the user. To decrease the time needed to deflate the cells and achieve a low pressure within the deflated cells, a means of suction, such as a vacuum pump is employed. This method of supporting the user still requires a sufficient air supply to support the entire weight of the user while operating. It is not a suitable cushion when non active because the air cells do not provide support when unpressurized. Therefore, it would be desirable to have a new and improved active cushioning structure formed of a matrix of four or more cells where multiple cells could be selectively deflated in a selected pattern, but where less than ¼ of the cells were deflated at a time. The deflation of a minority fraction of the cells has the synergistic effect of reducing power consumption and noise and at the same time limiting the incremental increase in pressure on the rest of the supported body. It is desirable to have a device where the cells incorporate open-celled foam within the vacuum cell membranes which substantially completely cover the supporting structure to provide fully cushioned support in the absence of electrical power. Such a device is particularly desirable where the contact pressure is not increased by more than 25% during a cell group's collapse. Such a device is inherently efficient because of the recovery of energy stored in the compressed foam. Additional energy efficiency can be achieved by cross-manifolding a cell being exhausted with one that is being refilled.

SUMMARY OF THE INVENTION

In accordance with an exemplary embodiment of the invention, the deficiencies of prior art designs are overcome in a cushioned support that incorporates both resilient passive cushioning and vacuum manifolding to multiple cells that encase the passive cushioning.

The object of this invention is to provide an active, human body support for safe, comfortable, long time, sitting or reclining that enables a continuously satisfactory level of tissue oxygen in all body contact regions without body movement by the user.

The embodiment features:

a) an upper body cushioning and support surface b) a multiplicity of deformable support cells having an internal volume and that includes a void space filled with a fluid which in the present embodiment is air;

c) means to remove fluid on a cyclic basis from deformable support cells to cause their deflation and collapse; and d) means to allow the fluid to return to deformable support cells to cause their inflation after a certain duration of time has elapsed in the collapsed position.

The exemplary apparatus provides excellent passive support when not activated (powered).

The support includes the following system components:

1) vacuum pump;

2) a manifold connecting each cell to the vacuum pump;

3) a valve system interposed between the valve and manifold with multiple parts for periodically connecting cells or groups of cells to the vacuum pump.

When activated, the apparatus continuously maintains adequate tissue oxygen level and comfort in all body contact regions without user effort.

The apparatus works in harmony with the physiological characteristics of the human body venous system response when subjected to local external surface forces in sitting or reclining positions.

The apparatus functions with minimum power consumption, noise and vibration making its presence known only by the absence of discomfort.

DETAILED DESCRIPTION OF THE DRAWINGS

Figure 1:
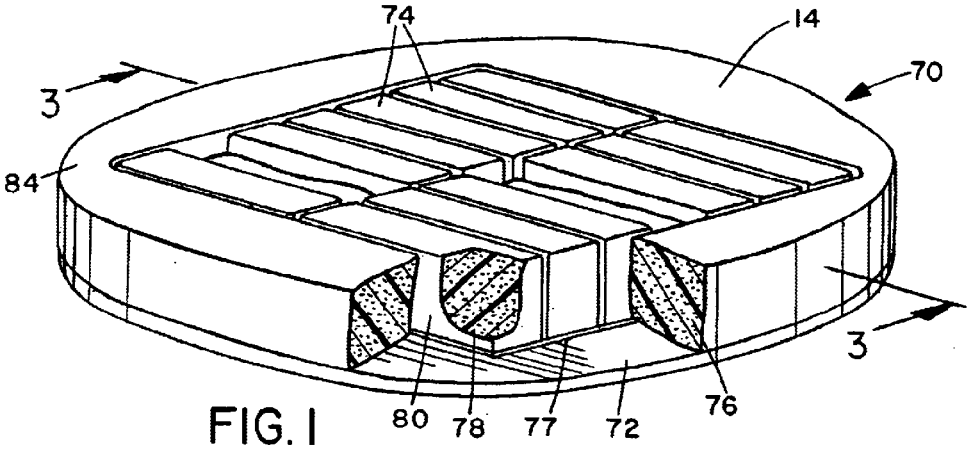
FIG. 1 is a perspective view of a seat support plate, perimeter lateral retention band, and cell array on carrier sheet with cut-away section showing a typical cell interior and two deflated cells in the array.

The support 70 of the invention illustrated in FIG. 1. comprises a structural support plate 72 upon which is mounted a carrier sheet 77 that carries a plurality of support cells 74. Each support cell comprises a flexible, low hysteresis, elastic, open cell foam or other elastomeric foam 76 with interconnected cells having a high void volume core 78 encased in a thin, flexible, impermeable membrane 80. A perimeter retention band structure 84 with cushioning properties similar to the cell cores retains the cells 74 laterally on the support plate 72. With the addition of an appropriate upholstery covering, the support plate cells and retention band provide a comfortable, passive human support system.

Any cell 74 of this support 70 can be made active by evacuating the internal fluid (air) which results in the collapse of the cell by (external) atmospheric pressure. The collapse of a cell 74 removes it from supporting the user in that region and reduces the skin contact pressure to a value below the local capillary pressure, thus allowing local blood flow to be reestablished to transport oxygen to the local tissue. Because only one or two of the plurality of cells is collapsed at any time, the average contact pressure on that portion of the body supported on the remaining cells is not greatly increased.

After a selected period of collapse, the cell 74 is vented to atmosphere where it re-inflates itself to atmospheric pressure assisted by the restorative forces of the foam. When re-inflated, the cell assumes its proportionate share of support in the array of cells. A collapsed period on the order of one minute is satisfactory to re-establish tissue blood flow after it has been occluded by sustained contact pressure for a period of time on the order of 10 minutes. Therefore, the preferred length of time of time to collapse is one minute or longer. The optimum frequency of collapsing is within the range of every 2 to 10 minutes. The maximum of the range may extend up to 30 minutes and still achieve significant benefit.

Figure 3:
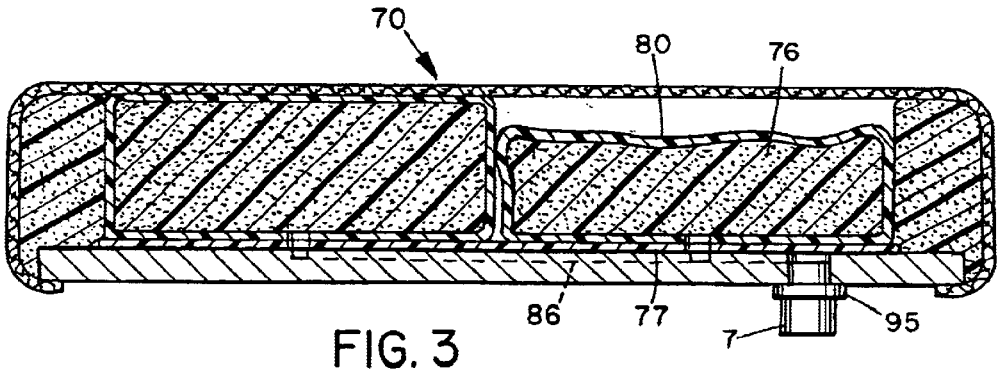
FIG. 3 is a cross-section of seat cells on a carrier sheet, perimeter lateral retention band, support plate with internal fluid manifold channels and rotary valve. Section taken on cutting plane A—A of FIG. 1.
Figures 2, 5A:
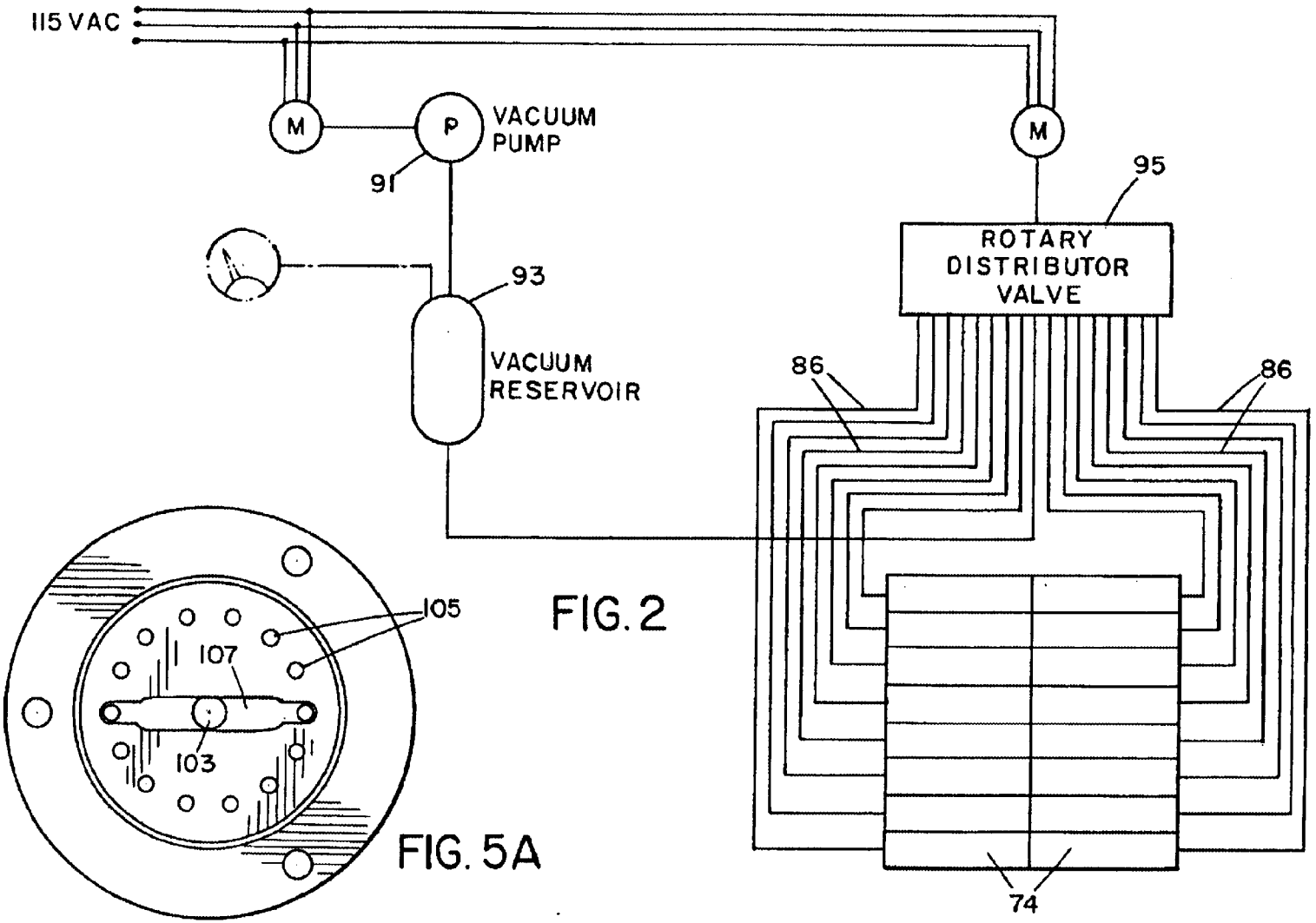
FIG. 2 is a system schematic diagram for a typical two-column, fourteen-cell cell array with rotary distributor valve.
FIG. 5*a* is a cross-section of a rotary valve with the optional cross-over porting.
Figure 4:
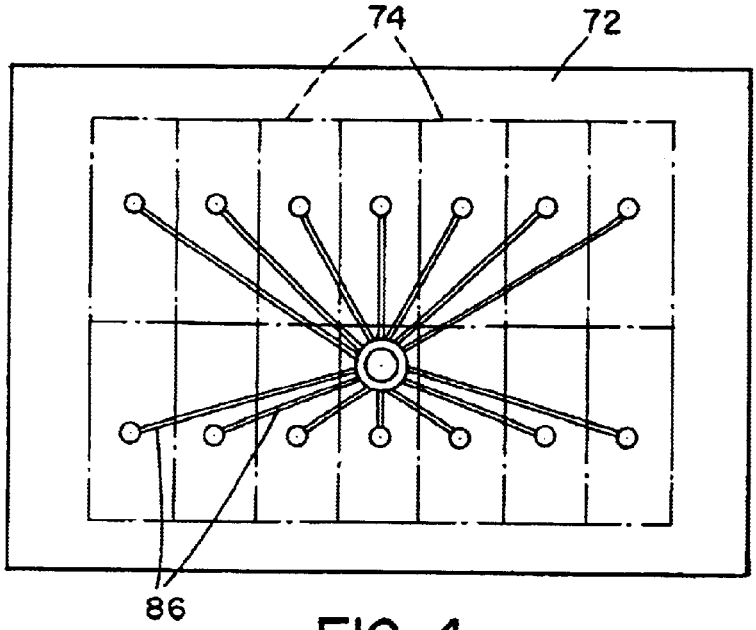
FIG. 4 is a plain view of a typical manifold pattern for two-column cell array.

As illustrated in FIG. 2, the array of cells 74 is connected by a manifold of individual channels 86 for each cell, or group of cells, to distributor valve 95 that provides, in effect, a three-way valve for each cell. In the preferred embodiment, as illustrated in FIGS. 3 and 4, the manifold and channels 86 are a structural part of the seat support plate 72 and formed by sealing channels 86 in the support plate 72 with the carrier sheet 77. Alternatively, the manifold may consist of individual tubing connecting each cell to the valve. When tubing is used, the tubing is preferably routed under the seat plate to holes directly under individual cells. A decorative plate on the undersurface of the seat would hide the tubing. The seat plate channels or tubes are protected from collapse by the inflation of adjacent cells because they are not routed between cells.

Figure 6:
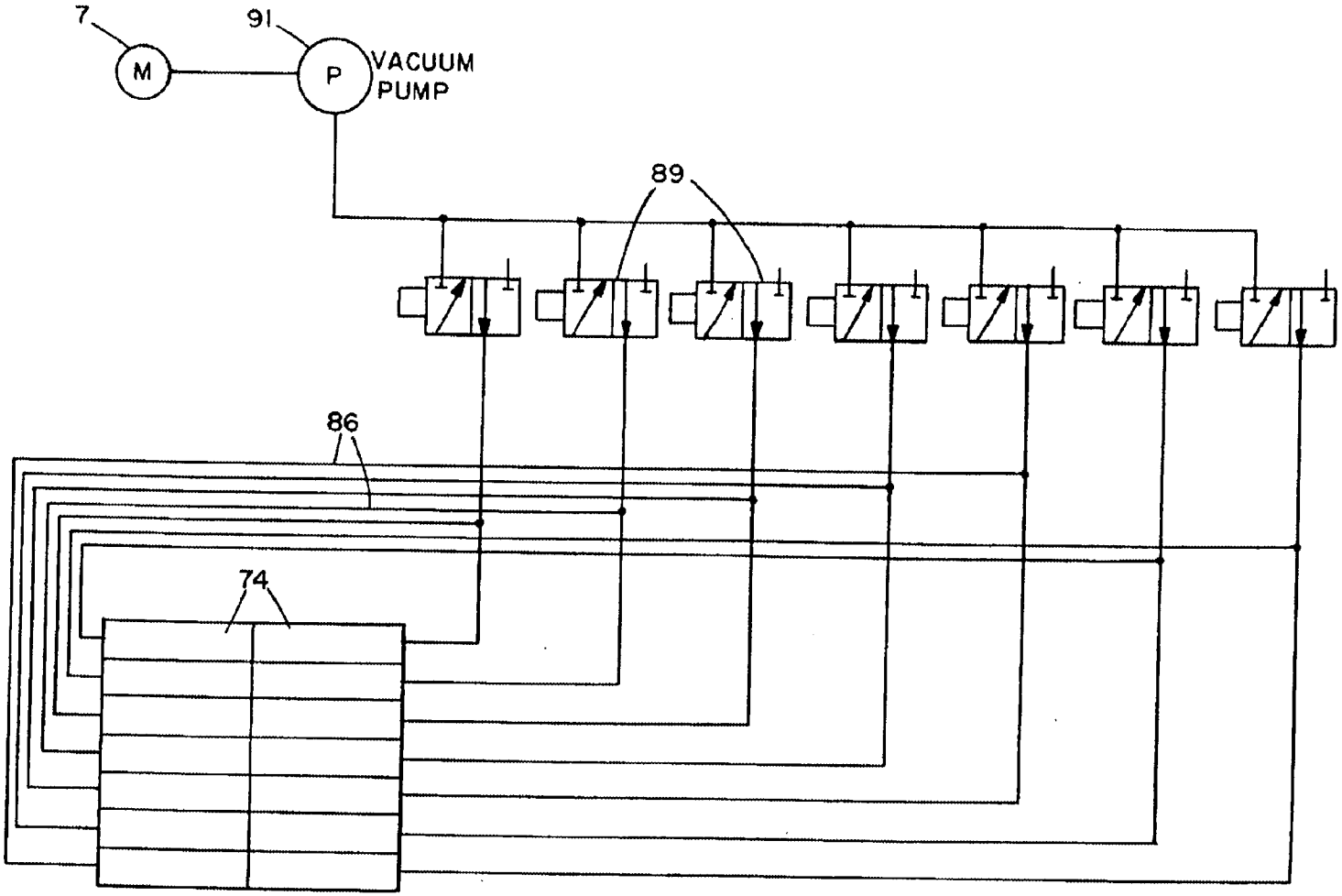
FIG. 6 is a system schematic diagram for cell array with individual solenoid valves.

The manifold tubing or channels have a cross sectional area ranging between 0.003 $in^2$ and 0.2 $in^2$. The use of small diameter tubing accommodates a large number of cells in a small area. The valve selectively connects cells to atmosphere or to a vacuum source. The schematic of FIG. 2 shows a rotary valve 95 and is the preferred structure. However, individual solenoid or cam-actuated motor driven valves 89 are suitable alternatives as shown in FIG. 6. The vacuum source for collapsing the active cells is a small flow capacity, electrically driven air pump 91 (FIG. 2). A vacuum reservoir 93 maximizes the utilization of the vacuum output. The range of vacuum level is 5 in $H_2O$ and greater. The preferred range is 10 to 50 in $H_2O$. This relatively low vacuum is made effective by the small cell size and the restorative effect of the foam. The valve controls the time period and sequence in which each cell is collapsed.

The use of vacuum to collapse the cells yields reduced energy consumption and pump capacity in comparison to positive inflation pressure. The energy to inflate empty, positive pressure, inflatable support structures comes entirely from the pressurized fluid supply and all of that energy leaves the system each time it is deflated. The elastic, collapsible internal member of the cells of the system disclosed here stores the energy supplied by the atmosphere in collapsing the cells as elastic energy and returns it during re-inflation to support the user. The amount of vacuum pump work to evacuate the void portion of the cell sufficiently to allow atmospheric pressure to collapse the elastic core is small.

Many support cell activation patterns or sequences can be accomplished with the apparatus described. The parameters of support cell activation are; collapsed time; number of cells collapsed at one time; phase relation of collapsed cells in the array; and duty cycle for individual cells in the array. The "fall" time to deflate a cell and "rise" time to inflate the cell are controlled by the port and rotor geometry of the rotary valve.

Figure 5:
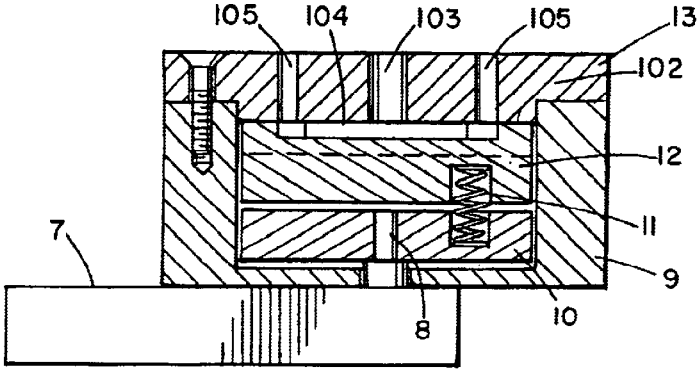
FIG. 5 is a rotary valve assembly cross section with gearmotor drive or addressable stepper motor drive.

A specific example of a suitable cell activation sequence will be understood by reference to a seat support array of 14 cells in two, side-by-side columns as depicted in FIG. 1 with a rotary valve 95 as seen in FIGS. 3, 5 and 5*a*. A basic mode of operation is achieved by a fixed speed of valve rotation by motor 7 with manifolding arranged to provide a 180 degree phase difference between cells in the two rows.

The rotary valve geometry controls the duration of collapse time relative to the cycle time and the rotor speed controls cycle time. This set of parameters yields continuous waves in each row traveling 180 degrees out of phase from either front to back (preferred) or from back to front for the opposite direction of valve rotation.

The user is always supported by 12 of the 14 cells, and is never unsupported at the same cell position on both sides of the array. The wave motion from front of seat to rear is preferred because it assists return flow of venous blood to the heart.

As an alternative to fixed speed rotation, the rotary valve may be driven by a stepper motor (not shown) in discreet, addressable steps to vary the duty cycle individually for each cell in the array, thus permitting cells in highly loaded regions to be made active more frequently or for longer times than cells in other regions of the array.

As an alternative to motor driven rotary valves, individual solenoid valves 89 may be utilized as shown in the schematic of FIG. 6.

Referring again to the rotary vacuum distributor valve assembly in FIG. 5. The valve 95 ports a vacuum source (pump) through port 103 to pairs of cells through ports 105 sequentially, in accordance with the schematic diagram of FIG. 2. The number of ports equals the number of pairs of cells to be activated sequentially. The rotational speed of the valve establishes the time between cell events. The port size and rotor cavity size establish the event duration. FIG. 5*a* shows an optional cross-over valve passage 107 that can be provided in the rotary valve rotor to reduce vacuum pump flow work during cell re-inflation by connecting the next cell to be evacuated to one about to be re-inflated for a brief period of pressure equalization between the cells. Subsequent valve rotation connects the cell to be evacuated to the vacuum source and the cell to be inflated to the atmosphere. In this way the net flow work done by the vacuum source is reduced.

Referring to FIG. 5, the gearmotor 7 rotates continually in operation. The valve cover 9 fixes and aligns non-rotating valve parts.

The drive disc 10 is fixed to the gearmotor output shaft 8 and rotates with the shaft.

Three or more compression springs 11 (one illustrated) serve to keep the rotor, 12, in light contact with the port plate, 13, in the axial direction and to transmit the gearmotor torque to the rotor. When the system is operating, the vacuum pressure force at the rotor/port plate interface keeps these parts in sealing contact. The springs 1I1 also accommodate any misalignment between rotor 12 and port plate 13.

The rotor 12 has a face 102 that is flat and makes a leak-proof connection to the port plate 13 as it rotates with respect to the port plate 13. The material of the rotor may be made of resin bonded graphite such as Pure Carbon Co. P8765 or molded Acetal plastic. The face 102 of the rotor 12 provides a vacuum area according to the geometry of the cavity 104 on the face and connects the vacuum source through the central port 103 in the port plate to this cavity. As the rotor 12 rotates, its cavity 104 comes into pneumatic communication with pairs of ports 105 in the port plate. These ports are coupled to cells via the manifold and thus the pairs of cells are evacuated as the rotor rotates and connects the vacuum source through the port plate 13 to ports 105. After a cell has been evacuated, the rotor rotates to connect the ports to another cavity which is open to atmosphere. When this happens the cell is backfilled and returned to atmospheric pressure. With this configuration of the rotor 12, only two cells at a time are connected to vacuum and all other cells are at atmospheric pressure.

Typical manifolding of the cells and the rotary valve are shown in FIG. 4. In this method of construction the manifold channels 86 are routed or molded into the upper surface of the support plate, starting at the transfer holes in the seat plate for the valve port plate, which is attached to the lower surface of the plate, and terminating under the appropriate cell.

The manifold channels are sealed, except at the termination under each cell, by the cell array carrier sheet 77 (see FIG. 1). Sealing of the carrier sheet to the support plate 72 may be by adhesive bonding or heat sealing. Alternative manifolding means (not shown) include discrete tubes connected from each valve port to each cell.

The deformable cell construction may take several forms. The construction shown in FIG. 3. comprises a thin-wall, thermo-formed enclosure 80 of polyurethane (PUR) film or other flexible thermoplastic or elastomer to enclose the open cell elastomeric foam core 76 with an impermeable membrane. This cell enclosure is bonded or heat sealed to the cell carrier sheet 77 around each cell perimeter to seal it from atmosphere and retain the cell core.

The thickness of the impermeable membrane 80 can be from 1 to 10 mils (0.02 to 0.25 mm). For thermo forming the PUR material may be PUR film as manufactured by J. P. Stevens Co. PUR has excellent abrasion resistance and tear and puncture resistance which is important in this application. Alternatively the PUR or other elastomeric material may be blow molded or injection molded in the thickness range specified above. The complete array of cells may be formed individually or as a group by any of the above processes.

The cell cores 78 must be principally open cell (sponge) of PUR material. The material stiffness must provide a comfortable passive support and be deformable with low vacuum pressure. The foam stiffness is characterized by the IFD (Indent Force Deflection) at 25% deflection (pounds/50 in sq. on 20"×20"×4"). The preferred range is 24 to 36 IFD and the max range would be 6–50 IFD. The preferred density range of the foam used in the cell core is 1–3 lb/ft$^3$. The maximum range would be 0.5–10 lb/ft$^3$. Open cell foams of other materials such as silicone rubber, neoprene rubber or elastomeric compounds may also be employed.

Figure 8:
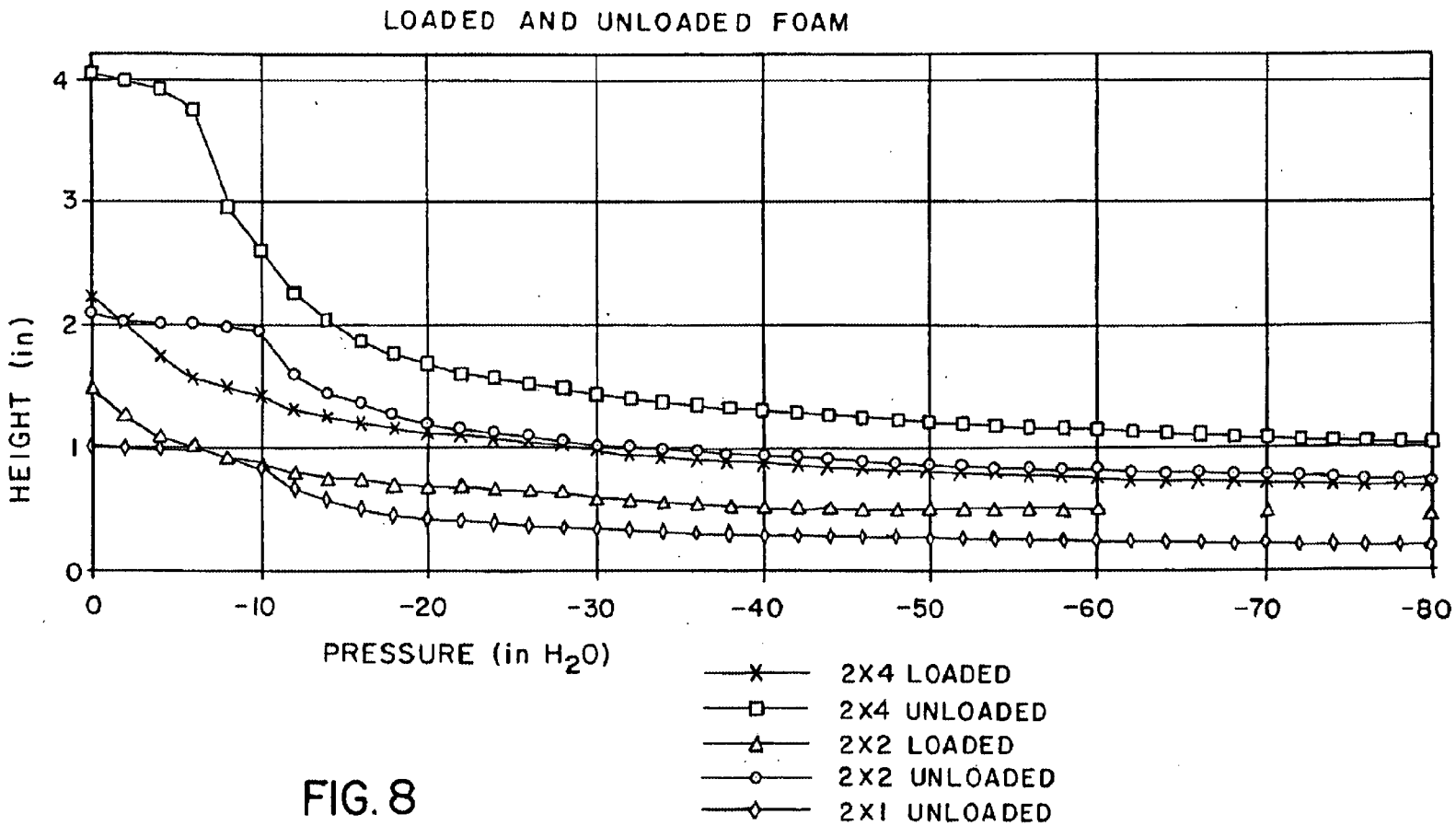
FIG. 8 illustrates the range of vacuum pressures vs. foam heights that can be achieved with small negative pressures.

FIG. 8 shows the relationship between the amount of deflection in height for the stated negative pressures. The figure represents foam in the range of stiffness described and with cell sizes (in inches from 1×2 to 2×4. Loaded weight-bearing and unloaded cells re included. The figure illustrates that relatively low vacuum pressures of 10 to 50 inches of water produce most of the deflection. The relatively low vacuum required validates the practice of using small vacuum pumps to reduce noise and cost.

Foam layers (not shown) within the cell may be provided to give non-linear spring rates to the cells under user applied loads. For instance, a lower stiffness foam may be provided in the upper most cell layer and a higher density in the lower layer. This construction prevents "bottoming out" of the foam on the support surface in passive cells with heavier occupants or in cells where the body loading is more concentrated, as in the ischial tuberosities area of the seat. Further stiffening of specific cells may be accomplished by using a layer of closed cell foam in the lowest position in the cell to prevent "bottoming out" in high load regions.

Alternative constructions for the cell cores with an impermeable surround include the use of molded, self skinning foam for the core or dipped or sprayed flexible sealing coatings or heat fusing of the cell outer layer.

The cellular array construction is well adapted to covering (tiling) seats that have contoured rigid support surfaces such as task chairs, event seating, transportation seating and wheel chair seats. Monolithic seat constructions tend to buckle on the upper surface when deformed against contoured rigid support surfaces unless they are premolded to the support shape. For example the 14 cell array described here easily accommodates a curvature chord to chordal height ratio of 10 to 1.

EXAMPLES OF APPLICATIONS FOR THE INVENTION

Office/Task Chair

People may spend hours at a time in their office or task chair while at work or using computers or video games. Even the very best passive support becomes uncomfortable during protracted periods of sitting. The present invention is able to prevent this discomfort while adding little in the way of distraction or inconvenience to the user.

Because of the very low power consumption of the present invention, the device is able to work for long periods of time from a small rechargeable battery. The battery, vacuum pump and vacuum distribution valve can all be suspended from beneath the rigid seat support/manifold structure. The weight of the chair is no more than 7 pounds more than a similar chair without the active cushion feature. The size of the chair is identical, as the cushion is no larger in plan view and the other components are mounted below the seat in space normally unoccupied by any hardware.

By way of example, if a 12 volt sealed, lead-acid battery is used with 4.5 amp-hour capacity (3.54×2.76×4.02 inches, 3.8 pounds) it is possible to operate the active seat system for 10 hours continuously before recharging. This is based on 0.4 amp draw from the vacuum pump and rotary distribution valve combination.

To further reduce power consumption and extend the operation of the system with the rechargeable battery, a switch sensitive to the weight of an occupant in the seat is fitted to the chair. This switch may be of several types familiar to those skilled in the art. When the switch is closed by an occupant's presence the vacuum pump and distribution valve will be operational. Immediately upon the switch opening, indicating the seat is-no longer occupied, the vacuum pump and distribution valve stop operating to save power.

The chair can be fitted with all the features normally expected in an office or task chair such as seat height adjustment, seat tilt, back height adjustment, reclining, casters, adjustable arm rests, etc. None of these features in any way interferes with the operation of the active seat cushion. Additionally, if the seat cushion is not operational (either because the occupant has turned off the active feature or the battery is discharged, etc.) the chair provides excellent support and normal seating comfort.

The chair may be fitted with a rudimentary on-off control or it may be supplied with a more advanced user interface. The user could program the frequency of the active seat cushion cycle or the cell activation pattern if an addressable type vacuum distribution valve is used.

The chair would be recharged as needed by connecting it to a wall plug mounted power supply via a low voltage electrical cord. The recharging would typically be done during periods when the chair is unoccupied so that the connection of the electrical cord to the chair would not be a nuisance. Most users would probably chose to recharge their chair at night, when they were away from the office.

Because the chair is operated in very quiet office settings, noise generated by the active seat system must be kept to a minimum. It is possible to enclose the vacuum pump in a housing that attenuates most of the pump's noise. A small vent is provided in the housing to allow the escape of the air discharged from the pump. Noise levels below 40 dBA at 1 meter distance are possible.

Residential or Nursing Home Bed

Figure 7:
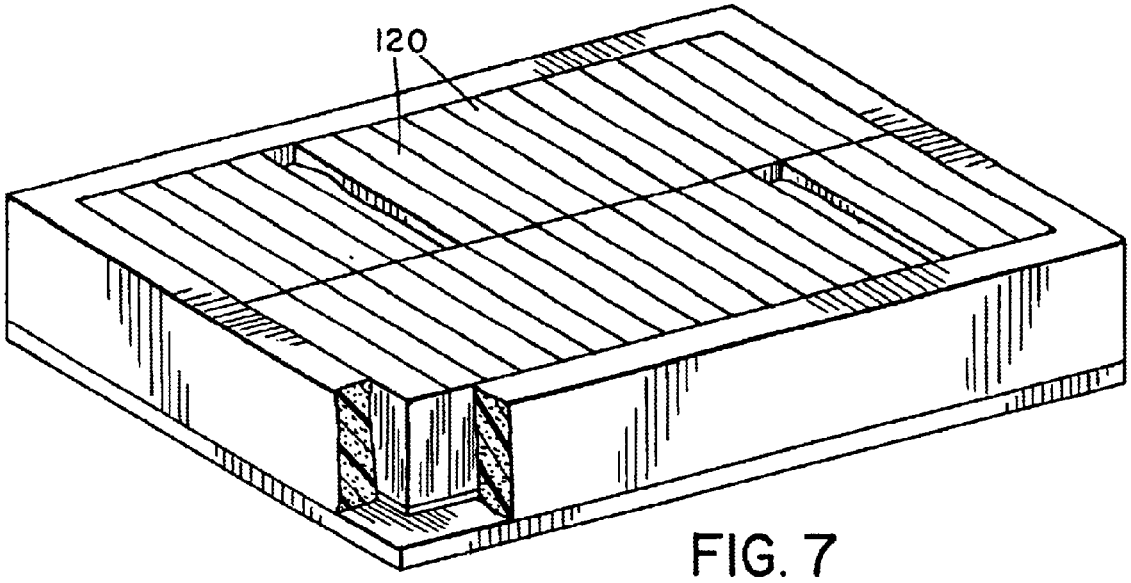
FIG. 7 is a perspective view of a mattress support plate, perimeter retention band, and cell array.

Beds in residences or nursing homes in which bed-ridden patients spend much of their time can be fitted with the present invention to prevent bedsores. Since these beds are rarely moved and are never used to transport a patient, they can be operated from mains power as opposed to rechargeable batteries. An example of such a mattress is shown in FIG. 7. The mattress is fitted with a number of active cells 120 in a symmetrical layout as discussed earlier. It is possible to provide zones for two people on one mattress should it be of sufficient size (such as a double, queen or king size). The vacuum pump and vacuum distribution valve may be located beneath the bed in a soundproof enclosure.

Hospital Bed

Since vacuum is often piped throughout hospitals, it is possible to eliminate the vacuum pump from systems used in hospitals. A connection is made from the bed to the wall fixture for vacuum. Since hospital beds are generally motorized for adjusting bed tilt, etc., mains power to operate the vacuum distribution valve is already present in the bed. Even though hospital beds are sometimes used for transport of patients, this process does not take much time and it is acceptable for the active mattress system to be nonoperational during transport.

Easy Chair

The present invention can be applied to stationary furniture such as easy chairs or couches. As with beds, these furniture items are not moved during use and hence can be powered from the mains conveniently. The vacuum pump and vacuum distribution valve would be mounted inside the base of the furniture item where it would not be visible or audible. A user interface control would be provided to control on-off function, activation patterns and cycle time.

Event Seating

The seating provided in venues such as symphony halls, theaters and stadiums could be fitted with the present invention to improve the comfort of patrons seated for long periods of time during events such as concerts, plays, movies and sporting events. Since a number of seats would be concentrated in a relatively small space, it would be beneficial to have a central vacuum pump of sufficient capacity to run all occupied seats. This vacuum pump could be installed at a distance from the seating to minimize the audible noise.

Transportation

The time spent traveling in automobiles, trucks, busses and airplanes (among others) is virtually all in the seated position. For long trips (over ½ to 1 hour) it will be beneficial to have the present invention applied to the seats in these various modes of transportation. All modern vehicles have an electrical supply bus as part of their normal systems. This bus would be used to supply power to individual seats to operate the vacuum pump and vacuum distribution valve. Alternatively, it would be possible to operate an engine driven vacuum pump to supply vacuum for seats. Intake manifold vacuum would also be a source of vacuum on some types of vehicles and would not require the addition of any hardware in the engine compartment. These forms of engine supplied vacuum make most sense in applications like buses or passenger airplanes with large numbers of seats.

Wheel Chairs

Many occupants of wheel chairs are vulnerable to pressure sores because they have no sensation in their buttock region. For this reason, the present invention can be especially useful when applied as a seat cushion in wheel chairs. Because of its very low power consumption, it is practical to operate over periods of 8 to 16 hours between battery recharges. The system would add very little weight to the wheel chair (no more than 7 pounds) and can be packaged so as not to make the chair larger overall.

Cushion Overlays

It may be desirable to "retrofit" a non-active support surface (seat or bed) to an active support surface as in the present invention. To do this, an overlay cushion with active cells may be placed on the non-active support surface. Depending on the application, these cushion overlays may operate with battery power or mains and with local vacuum sources or central sources.

We claim:

1. An active cushioning support incorporating an upper body cushioning and support surface wherein:

a plurality of active cells each having an active body support surface and an attachment surface, each cell comprising a substantially fluid impermeable membrane enclosing an active cushion volume;

a supporting surface for supporting said cells and the weight supported on said body contacting surface;

passive cushioning foam positioned below the nominal upper surface of a plurality of said active cells;

a vacuum source connected selectively to the active cushioning volume of a plurality of said active cells to cause the collapse of the active cushioning volume to retract said body contacting surface;

a manifold for distributing vacuum pressure to selected cells comprising distribution channels structurally isolated from said active cells to prevent interruption of the flow of vacuum in said channels by the action of the collapse of one or more of said active cells under the influence of vacuum or the weight of said body on said surface;

at least one vacuum distribution valve for periodically connecting and disconnecting one or more manifold distribution channels to said source of vacuum to successively collapse selected cells by application of the vacuum and then re-inflate of said selected cells by venting each said selected cell to atmosphere or cross manifolding said selected cell to one said cell being collapsed, said selected cells consisting of a minority of the cells.

2. The cushioning support of claim 1, wherein:

said supporting surface comprises a support plate having a plurality of substantially impermeable distribution channels extending from first vacuum connection ends to an active cell connection ends.

3. The cushioning support of claim 2, wherein:

said distribution channels comprises open topped channels in said support plate with a carrier sheet for sealing over said channels except at the point of connection to an active cell.

4. The cushioning support of claim 2, wherein:

said active cells are retained on said support plate by passive cushioning which borders said cells on at least two sides.

5. The cushioning support of claim 1, wherein:

said passive cushioning is located within said membrane.

6. The cushioning support of claim 4, wherein:

said passive cushioning comprises open celled foam.

7. The cushioning support of claim 5, wherein:

said foam substantially completely fills said active cell when said cell is not collapsed by connection to said source of vacuum.

8. The cushioning support of claim 1, wherein:

said valve is connected to collapse adjacent cells sequentially in a repeating pattern.

9. The cushioning support of claim 8 wherein:

the pattern of collapsing cells proceeds from front to rear of said support surface.

10. The cushioning support of claim, 1 wherein:

the vacuum distribution valve comprises at least one rotary motor-driven valve with multiple vacuum ports that are connected in a sequence determined by the rotary position of the valve.

11. The cushioning support of claim 10, wherein:

the rotary valve is driven by a continuously rotating motor.

12. The cushioning support of claim 10, wherein:

the rotary valve is driven be a stepper motor that may be indexing to connect to any selected vacuum port.

13. The cushioning support of claim 1 wherein:

the vacuum distribution valve has a series of reinflation channels to periodically connect each distribution channel to atmospheric pressure.

14. The cushioning support of claim 1, wherein:

the vacuum distribution valve comprises a plurality of solenoid operated valves to selectively connect at least one cell to said source of vacuum.

15. The cushioning support of claim 1, wherein:

there are at least 4 cells with at least 2 cells on each side of the longitudinal center line of said support surface.

16. The cushioning support of claim 15 wherein:

no more than one quarter of the cells are collapsed at the same time.

17. An active cushioning support for a chair seat incorporating an upper body cushioning and support surface wherein:

said chair seat is supported from seat support structure eight or more active cells each having an active body support surface and an attachment surface, each cell comprising a substantially fluid impermeable membrane enclosing an active cushion volume;

a seat supporting surface with a width-wise contour for supporting said cells and the weight supported on said body contacting surface;

a seat undersurface passive cushioning foam positioned below the nominal upper surface of a plurality of said active cells;

a vacuum pump connected selectively to the active cushioning volume of a plurality of said active cells to cause the collapse of the active cushioning volume to retract said body contacting surface;

a rechargeable battery for powering said vacuum pump and mounted on said seat support structure or seat undersurface;

a manifold for distributing vacuum pressure to selected cells comprising distribution channels structurally isolated from said active cells to prevent interruption of the flow of vacuum in said channels by the action of the collapse of one or more of said active cells under the influence of vacuum or the weight of said body on said surface;

at least one vacuum distribution valve for periodically connecting and disconnecting one or more manifold distribution channels to said source of vacuum to successively collapse selected cells by application of the vacuum and then re-inflate of said selected cells by venting each said selected cell to atmosphere or cross manifolding said selected cell to one said cell being collapsed, said selected cells consisting of a minority of the cells.

18. An active cushioning support wherein:

a plurality of active cells having an active support surface and an attachment surface, each cell comprising substantially fluid impermeable membrane enclosing an active cushion volume;

a supporting surface for supporting said cells and the weight supported on said support surface;

a vacuum source connected selectively to the active cushioning volume of a plurality of said active cells to cause the collapse of the active cushioning volume to retract said support surface;

a manifold for distributing vacuum pressure to selected cells comprising distribution channels; and at least one vacuum distribution valve for periodically connecting and disconnecting one or more manifold distribution channels to said source of vacuum to successively collapse selected cells by application of the vacuum and then re-inflate of said selected cells by venting each said selected cell to atmosphere or cross manifolding said selected cell to one said cell being collapsed, said selected cells consisting of a minority of the cells.

19. An active cushioning support for a chair seat incorporating a cushioning and support surface wherein:

said chair seat is supported from seat support structure with eight or more active cells each having an active support surface and an attachment surface;

each cell comprising a substantially fluid impermeable membrane enclosing an active cushion volume;

a vacuum pump connected selectively to the active cushioning volume of a plurality of said active cells to cause the collapse of the active cushioning volume to retract said body contacting surface;

a rechargeable battery for powering said vacuum pump and mounted on said seat support structure or seat undersurface;

a manifold for distributing vacuum pressure to selected cells comprising distribution channels; and at least one vacuum distribution valve for periodically connecting and disconnecting one or more manifold distribution channels to said source of vacuum to successively collapse selected cells by application of the vacuum and then re-inflate of said selected cells by venting each said selected cell to atmosphere or cross manifolding said selected cell to one said cell being collapsed, said selected cells consisting of a minority of the cells.

* * * * *